US012552586B2

(12) United States Patent
Gonuguntla et al.

(10) Patent No.: US 12,552,586 B2
(45) Date of Patent: Feb. 17, 2026

(54) LID ASSEMBLY HAVING A SEAL MECHANISM FOR A CONTAINER

(71) Applicant: Leapfrog Product Development LLC, Chicago, IL (US)

(72) Inventors: Jaswanth Chowdary Gonuguntla, Chicago, IL (US); Steven N. Pinelli, Chicago, IL (US)

(73) Assignee: Leapfrog Product Development LLC, Chicago, IL (US)

( * ) Notice: Subject to any disclaimer, the term of this patent is extended or adjusted under 35 U.S.C. 154(b) by 67 days.

(21) Appl. No.: 18/506,330

(22) Filed: Nov. 10, 2023

(65) Prior Publication Data

US 2024/0158143 A1 May 16, 2024

Related U.S. Application Data

(60) Provisional application No. 63/424,528, filed on Nov. 11, 2022.

(51) Int. Cl.

| | |
|---|---|
| ***B65D 51/18*** | (2006.01) |
| ***B65D 43/02*** | (2006.01) |
| ***B65D 43/16*** | (2006.01) |
| ***B65D 43/22*** | (2006.01) |
| ***B65D 43/26*** | (2006.01) |
| ***B65D 51/16*** | (2006.01) |
| ***B65D 53/00*** | (2006.01) |

(52) U.S. Cl.

CPC ..... *B65D 51/18* (2013.01); *B65D 43/0214* (2013.01); *B65D 43/165* (2013.01); *B65D 43/22* (2013.01); *B65D 43/26* (2013.01); *B65D 51/1683* (2013.01); *B65D 53/00* (2013.01); *B65D 2205/00* (2013.01); *B65D 2251/0021* (2013.01); *B65D 2251/0081* (2013.01); *B65D 2251/1058* (2013.01); *B65D 2251/1075* (2013.01); *B65D 2543/00148* (2013.01)

(58) Field of Classification Search

CPC .. B65D 51/18; B65D 43/0214; B65D 43/165; B65D 43/22; B65D 43/26; B65D 51/1683; B65D 53/00; B65D 2205/00; B65D 2251/0021; B65D 2251/0081; B65D 2251/1058; B65D 2251/1075; B65D 2543/00148

USPC ..... 220/254.2, 715, 826

See application file for complete search history.

(56) References Cited

U.S. PATENT DOCUMENTS

| | | | | |
|---|---|---|---|---|
| 8,960,490 | B2 * | 2/2015 | Carlile | B65D 47/249 220/264 |
| 9,238,529 | B1 * | 1/2016 | Newman | B65D 47/32 |
| 2015/0201776 | A1 * | 7/2015 | Elsaden | A47G 19/2272 220/715 |

* cited by examiner

*Primary Examiner* — James N Smalley

(74) *Attorney, Agent, or Firm* — Barnes & Thornburg LLP

(57) ABSTRACT

A lid assembly for a container. The lid assembly has a lid body, a flap, a seal and a button. The lid body has a lid opening. The flap is pivotally connected to the lid body and pivots away between an open position and a closed position. In the closed position the flap closes the lid opening. In the open position the lid opening is open and a cavity of the container is accessible therethrough. The seal is connected to one of the lid body or the flap to seal the opening when the flap is in the closed position. The button is pivotally connected to the lid body and pivots between an actuated and an unactuated position. When the button is moved to the actuated position the flap moves to the open position.

18 Claims, 7 Drawing Sheets

LID ASSEMBLY HAVING A SEAL MECHANISM FOR A CONTAINER

CROSS-REFERENCE TO RELATED APPLICATIONS

This application claims the benefit of U.S. Provisional Patent Application No. 63/424,528 filed Nov. 11, 2022, which is expressly incorporated herein by reference and made a part hereof.

FEDERALLY SPONSORED RESEARCH OR DEVELOPMENT

Not Applicable.

TECHNICAL FIELD

The present subject matter relates to a lid assembly for a container, and more particularly, to a lid assembly having a seal mechanism for a lid of a container.

BACKGROUND

Containers are known in the art, including containers that have lids and sealable openings. While such containers according to the prior art provide a number of advantages, they nevertheless have certain limitations. The present disclosure seeks to overcome certain of those limitations and other drawbacks of the prior art, and to provide new features not heretofore available. A full discussion of the features and advantages of the present disclosure is deferred to the following detailed description, which proceeds with reference to the accompanying drawings.

SUMMARY

According to certain aspects of the present disclosure, the disclosed subject technology relates to a container having a lid with a sealable opening.

The disclosed technology further relates to a lid assembly for a container, comprising: a lid body having a first end and a second end, a lid opening extending through the lid body adjacent the second end of the lid body, and a vent opening; a flap pivotally connected to the lid body, the flap pivoting between an open position and a closed position, wherein the flap closes the lid opening in the lid body when the flap is in the closed position, and wherein when the flap is in the open position the lid opening in the lid body is open and a cavity of the container is accessible therethrough; a seal connected to the flap to seal the opening when the flap is in the closed position; a linearly moveable latch moving from a first position to a second position, the latch having a cam surface and an engaging member, the engaging member adapted to secure the flap in the closed position when the latch is in the first position, and the engaging member adapted to release the flap to the open position when the latch is in the second position; a button pivotally connected to the lid body adjacent the first end of the lid body, the button pivoting between an actuated position and an unactuated position, the button having an extension that engages the cam surface to move the latch from the first position to the second position when the button is moved to the actuated position, the button further having a vent plunger; a vent seal within the vent opening, the vent plunger engaging the vent seal to open the vent opening when the button is moved to the actuated position.

The disclosed technology further relates to a lid assembly for a container, comprising: a lid body having a first end and a second end, a lid opening extending through the lid body adjacent the second end of the lid body; a flap pivotally connected to the lid body, the flap pivoting between an open position and a closed position, wherein the flap closes the lid opening in the lid body when the flap is in the closed position, and wherein when the flap is in the open position the lid opening in the lid body is open and a cavity of the container is accessible therethrough; a seal connected to one of the lid body and the flap to seal the opening when the flap is in the closed position; a latch moveable about the lid assembly from a first position to a second position, the latch adapted to secure the flap in the closed position when the latch is in the first position, and the latch adapted to release the flap to the open position when the latch is in the second position; and, a button pivotally connected to the lid body adjacent the first end of the lid body, the button pivoting between an actuated position and an unactuated position, the button moving the latch from the first position to the second position when the button is moved to the actuated position.

The disclosed technology further relates to a lid assembly for a container, comprising: a lid body having a first end and a second end, a lid opening extending through the lid body adjacent the second end of the lid body; a flap pivotally connected to the lid body adjacent the second end of the lid body, the flap pivoting away from the lid body between an open position and a closed position, wherein the flap closes the lid opening in the lid body when the flap is in the closed position, and wherein when the flap is in the open position the lid opening in the lid body is open and a cavity of the container is accessible therethrough; a seal connected to one of the lid body and the flap to seal the opening when the flap is in the closed position; a button pivotally connected to the lid body adjacent the first end of the lid body, the button pivoting between an actuated position and an unactuated position, the button operably moving the flap from the closed position to the open position when the button is moved to the actuated position; a first bias member to bias the flap to the open position; and, a second bias member to bias the button to the unactuated position.

The disclosed technology further relates to a lid assembly for a container, further comprising a lid seal around the lid body for sealing the lid body against the container.

The disclosed technology further relates to a lid assembly for a container, wherein the flap has pivot members extending therefrom, the pivot members of the flap engaging receivers of the lid body, and the flap pivoting about the pivot members in the receivers.

The disclosed technology further relates to a lid assembly for a container, wherein the button has pivot members extending therefrom, the pivot members of the button engaging receivers of the lid body, and the button pivoting about the pivot members in the receivers.

The disclosed technology further relates to a lid assembly for a container, further comprising a bias member to bias the flap to the open position.

The disclosed technology further relates to a lid assembly for a container, further comprising a bias member to bias the button to the unactuated position.

The disclosed technology further relates to a lid assembly for a container, further comprising a bias member to bias the latch to the first position.

The disclosed technology further relates to a lid assembly for a container, wherein the flap has a hook extending from the flap to engage the engaging member of the latch when the flap is moved to the closed position.

The disclosed technology further relates to a lid assembly for a container, wherein the lid body has a channel to slidingly receive the latch.

The disclosed technology further relates to a lid assembly for a container, wherein the lid body has a vent opening, wherein a vent seal is provided within the vent opening, wherein the button has a vent plunger, and wherein the vent plunger engages the vent seal to open the vent opening when the button is moved to the actuated position.

The disclosed technology further relates to a lid assembly for a container, wherein the latch moves a linearly about a channel in the lid body from the first position to the second position.

The disclosed technology further relates to a lid assembly for a container, wherein the latch has a cam surface and an engaging member, the engaging member adapted to secure the flap in the closed position when the latch is in the first position, and the engaging member adapted to release the flap to the open position when the latch is in the second position.

The disclosed technology further relates to a lid assembly for a container, wherein the button has an extension that engages a cam surface of the latch to move the latch from the first position to the second position when the button is moved to the actuated position.

The lid assembly of claim 15, further comprising a latch moveable about the lid assembly from a first position to a second position, the latch adapted to secure the flap in the closed position when the latch is in the first position, and the latch adapted to release the flap to the open position when the latch is moved to the second position, wherein the button moves the latch from the first position to the second position to open the flap.

The disclosed technology further relates to a lid assembly for a container, wherein the latch has a cam surface and an engaging member, the engaging member adapted to secure the flap in the closed position when the latch is in the first position, and the engaging member adapted to release the flap to the open position when the latch is in the second position.

The disclosed technology further relates to a lid assembly for a container, wherein the button has an extension that engages the cam surface of the latch to move the latch from the first position to the second position when the button is moved to the actuated position.

The disclosed technology further relates to a lid assembly for a container, further comprising a lid seal around the lid body for sealing the lid body against the container.

The disclosed technology further relates to a lid assembly for a container, wherein the flap and the button pivot in opposite directions.

It is understood that other embodiments and configurations of the subject technology will become readily apparent to those skilled in the art from the following detailed description, wherein various configurations of the subject technology are shown and described by way of illustration. As will be realized, the subject technology is capable of other and different configurations and its several details are capable of modification in various other respects, all without departing from the scope of the subject technology. Accordingly, the drawings and detailed description are to be regarded as illustrative in nature and not as restrictive.

BRIEF DESCRIPTION OF THE DRAWINGS

To understand the present disclosure, it will now be described by way of example, with reference to the accompanying drawings in which embodiments of the disclosures are illustrated and, together with the descriptions below are incorporated in and constitute a part of this specification, and serve to explain the principles of the disclosure. In the drawings.

Figure 1:
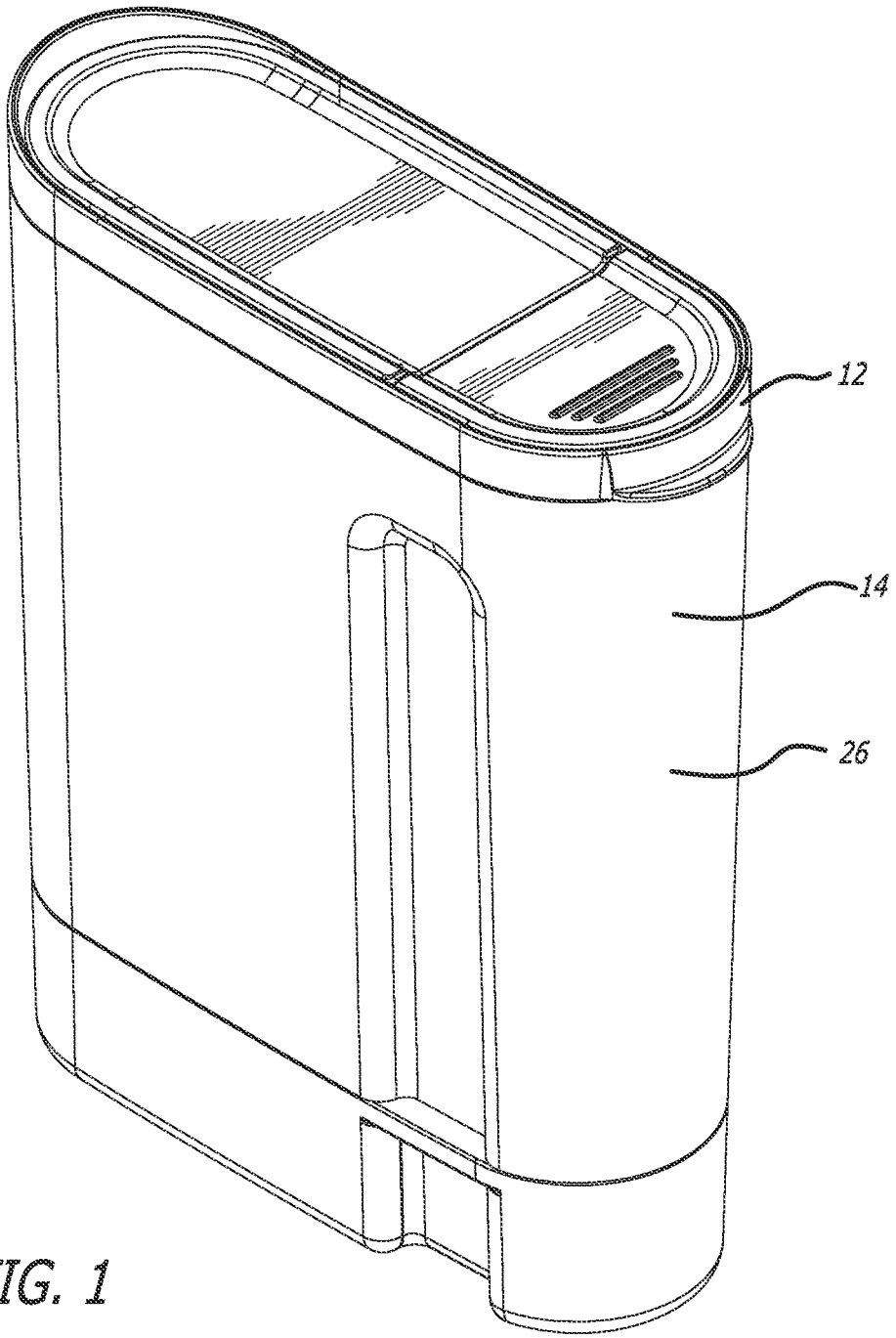
FIG. 1 is a perspective view of a container having a lid assembly with a seal mechanism, according to the present disclosure.

In one or more implementations, not all of the depicted components in each figure may be required, and one or more implementations may include additional components not shown in a figure. Variations in the arrangement and type of the components may be made without departing from the scope of the subject disclosure. Additional components, different components, or fewer components may be utilized within the scope of the subject disclosure.

DETAILED DESCRIPTION

While this disclosure is susceptible of embodiments in many different forms, there is shown in the drawings and will herein be described in detail preferred embodiments with the understanding that the present disclosure is to be considered as an exemplification of the principles of the disclosure and is not intended to limit the broad aspect of the disclosure to the embodiments illustrated. It should be noted that the features illustrated in the drawings are not necessarily drawn to scale, and features of one embodiment may be employed with other embodiments as one of ordinary skill in the relevant art would recognize, even if not explicitly stated herein. Further, descriptions of well-known components and processing techniques may be omitted so as to not unnecessarily obscure the embodiments of the present disclosure. The examples used herein are intended merely to facilitate an understanding of ways in which the present disclosure may be practiced and to further enable those of ordinary skill in the art to practice the embodiments of the present disclosure. Accordingly, the examples and embodiments herein should not be construed as limiting the scope of the present disclosure, which is defined solely by the appended claims and applicable law.

Figure 4:
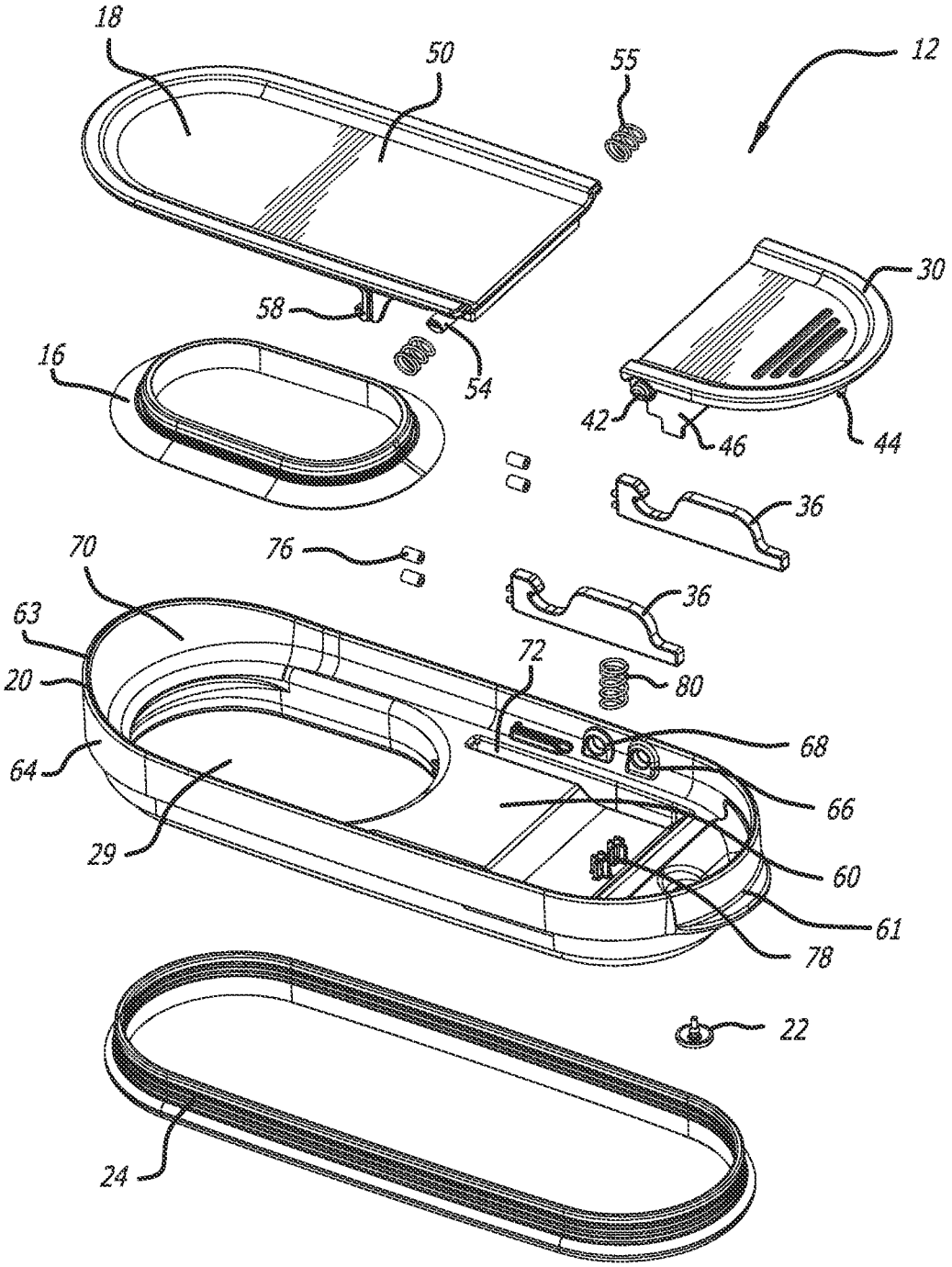
FIG. 4 is an exploded view of one embodiment of a lid assembly and seal mechanism, according to the present disclosure.

Generally, this disclosure describes several embodiments of seal mechanisms 10 for a lid assembly 12 for a container 14, such as a food container, that are arrangeable in a variety of different orientations, both alone and in combination. In one embodiment, as shown in FIG. 4, the seal mechanism 10 for the lid assembly 12 has three different seals: a first seal 16 to seal the flap 18 against the lid body 20 to sealingly close the opening 29 in the lid body 20; a second seal 22 that operates as a vent seal for the lid assembly 12; and, a third seal 24 that seals the overall lid assembly 12 to the container body 26. In alternate embodiments, one or more of the seals may be omitted, such as, for example, in one alternate embodiment the vent seal may be omitted.

Figure 2:
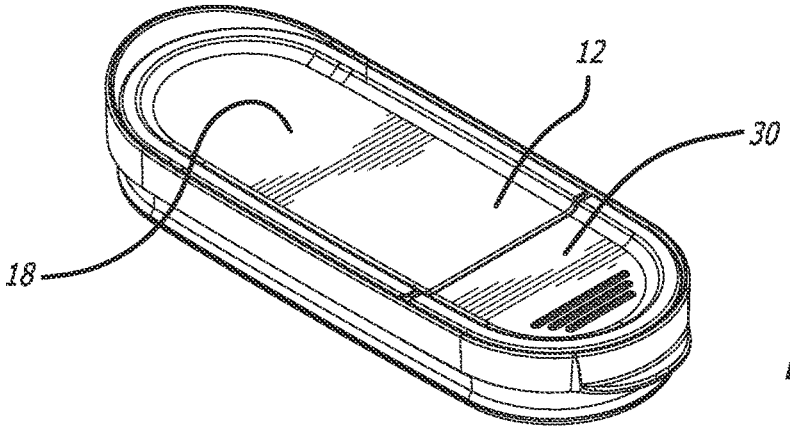
FIG. 2 is a perspective view of the lid assembly of FIG. 1, having a seal mechanism, according to the present disclosure.
Figure 3:
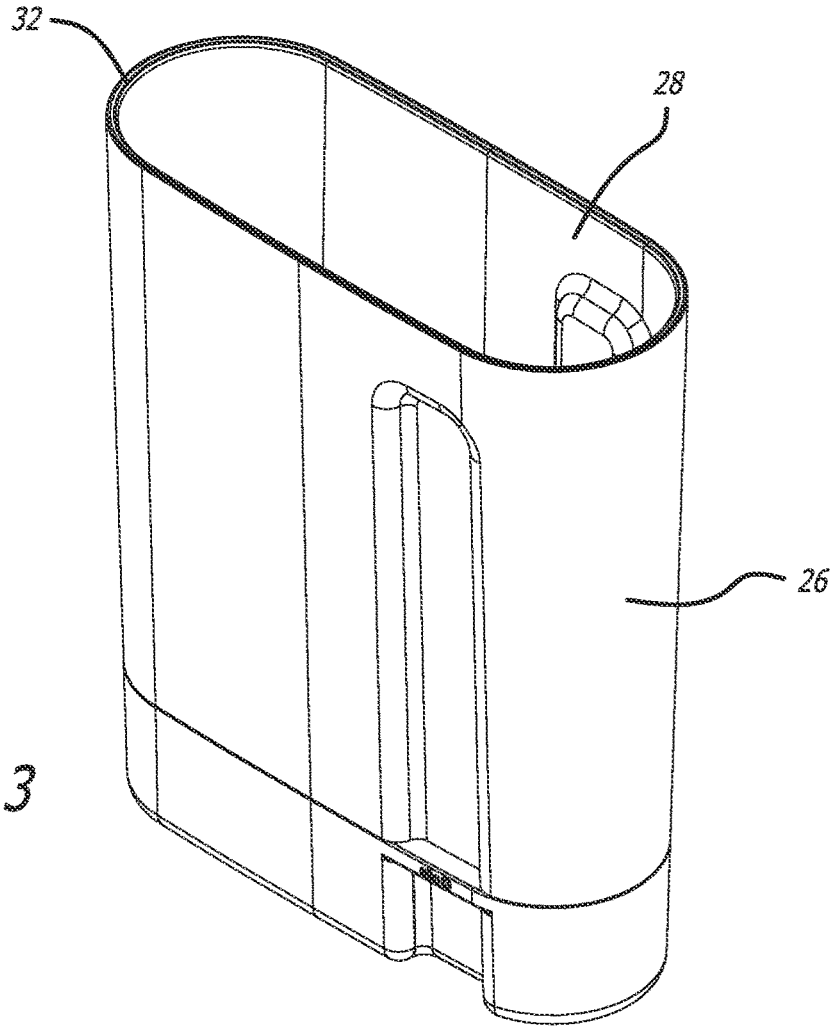
FIG. 3 is a perspective view of the container of FIG. 1, according to the present disclosure.

Referring now to the figures, and initially to FIGS. 1-3, there is shown an embodiment of a container 14 having a lid assembly 12 and a container body 26. In one embodiment, the container body 26 has an interior cavity 28 that is accessible via an opening 32 in the container body 26. Further, in one embodiment, the lid assembly 12 is removably connected and sealed to the container body 26 to sealingly close the interior cavity 28 of the container body 26. In a preferred embodiment, the lid assembly 12 has an openable flap 18 to provide access to the interior cavity 28 of the container body 26 through an opening 29 in the lid body 20 when the lid assembly 12 is connected to the container body 26.

In one embodiment, as shown in the exploded view of FIG. 4, the lid assembly 12 generally comprises a lid body 20, a lid seal 24, also referred to as the third seal 24 to seal the lid body 20 to the container body 26 at the opening 32 of the container body 26, a flap 18 that is pivotally connected to the lid body 20 that covers the opening 29 in the lid body 20, a flap seal 16, also referred to as the first seal 16 that seals the flap 18 to the lid body 20 around the opening 29 in the lid body 20, and a button 30 that is pivotally connected to the lid body 20 and which operates to open the flap 18 and the vent seal 22. Additionally, in one embodiment, the lid assembly 12 has opposing latches 36. The latches 36 operate to retain the flap 18 in the closed position when the latches 36 are in a first position, but when the latches 36 are moved to a second position the flap 18 disengages from the latches 36 and is biased to an open position. The button 30 operates to move the latches 36 from the first position to the second position as shown in FIGS. 7 and 8.

Figure 5:
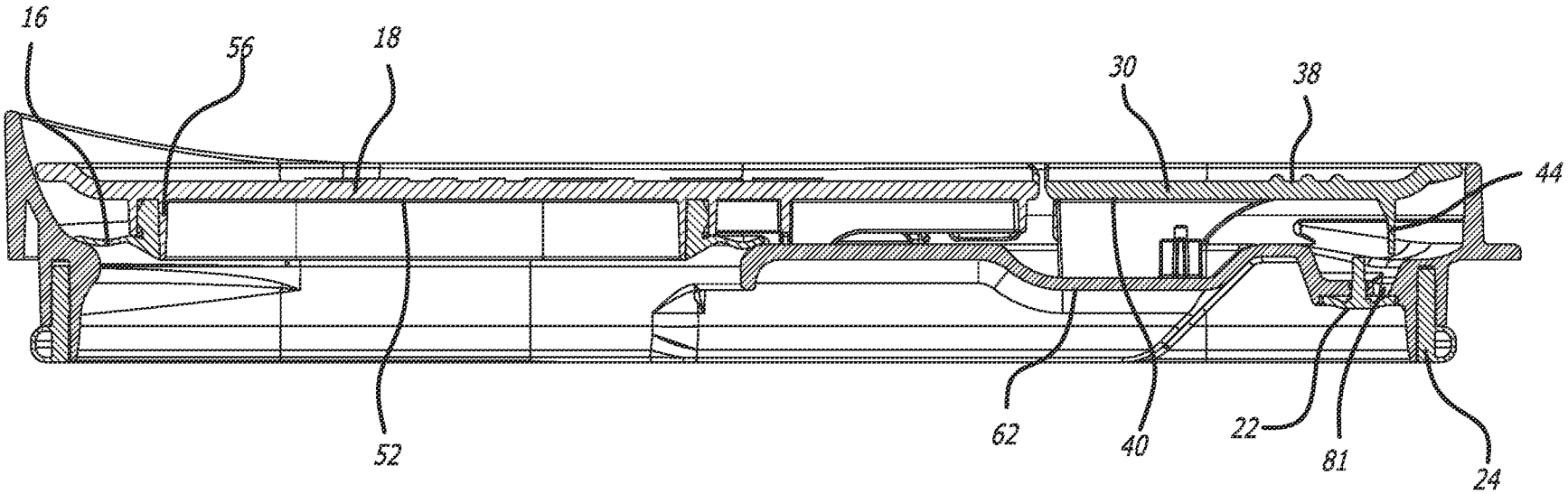
FIG. 5 is a cross-sectional view about a centerline of one embodiment of a lid assembly and seal mechanism, with the seal mechanism in the closed position.
Figure 6:
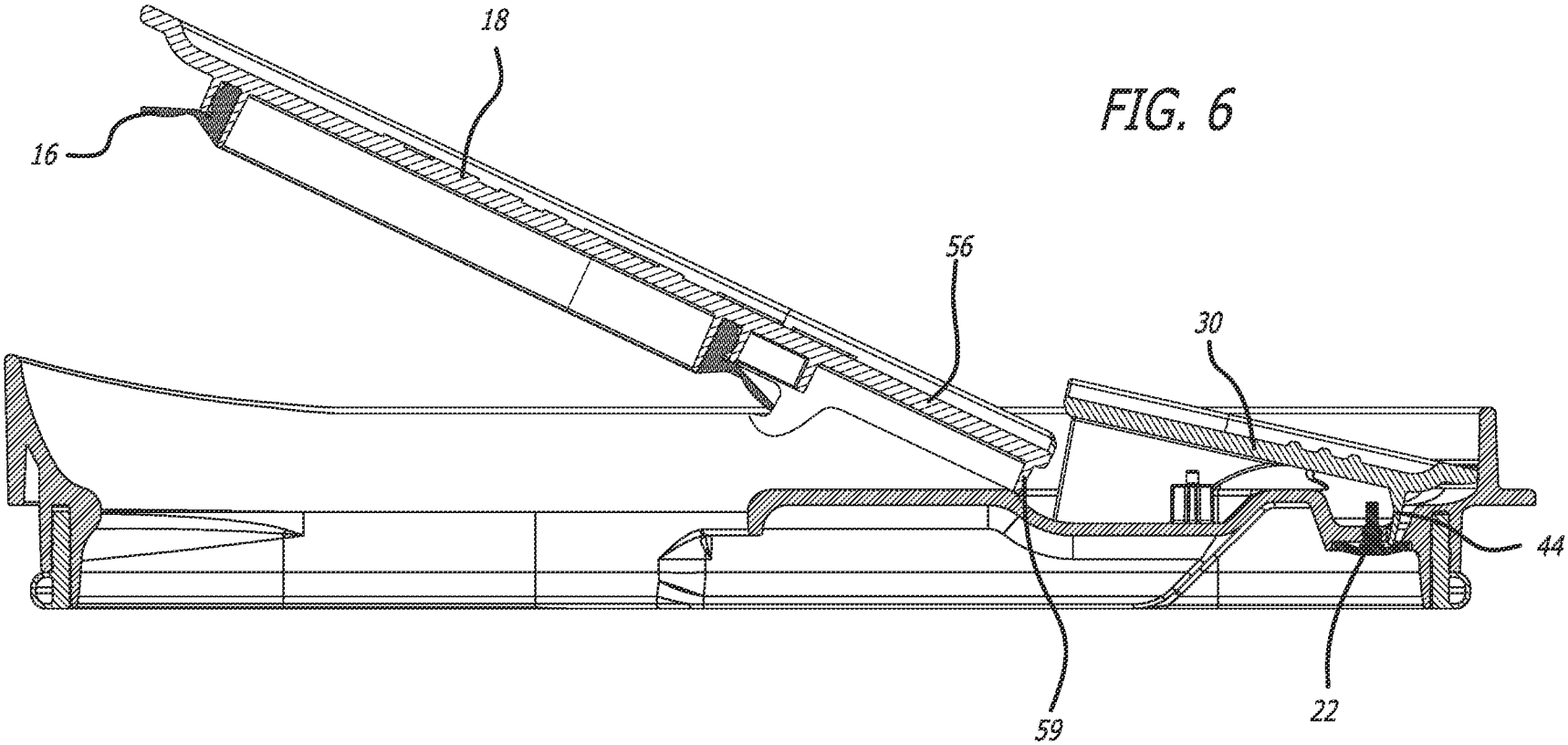
FIG. 6 is a cross-sectional view about a centerline of one embodiment of a lid assembly and seal mechanism, with the seal mechanism in the open position.

As shown in FIGS. 4, 5 and 6, the button 30 has a first outer surface 38 and a second inner surface 40. The button 30 also has opposing posts 42 extending outwardly. The button 30 is able to pivot about the opposing posts 42 with respect to the container body 26 between an unactuated position of the button 30 as shown in FIG. 5, and the actuated position of the button 30 as shown in FIG. 6. The button 30 also has a vent plunger 44, and a pair of extensions 46. The extensions 46 engage the latches 36 as described herein.

Figure 7:
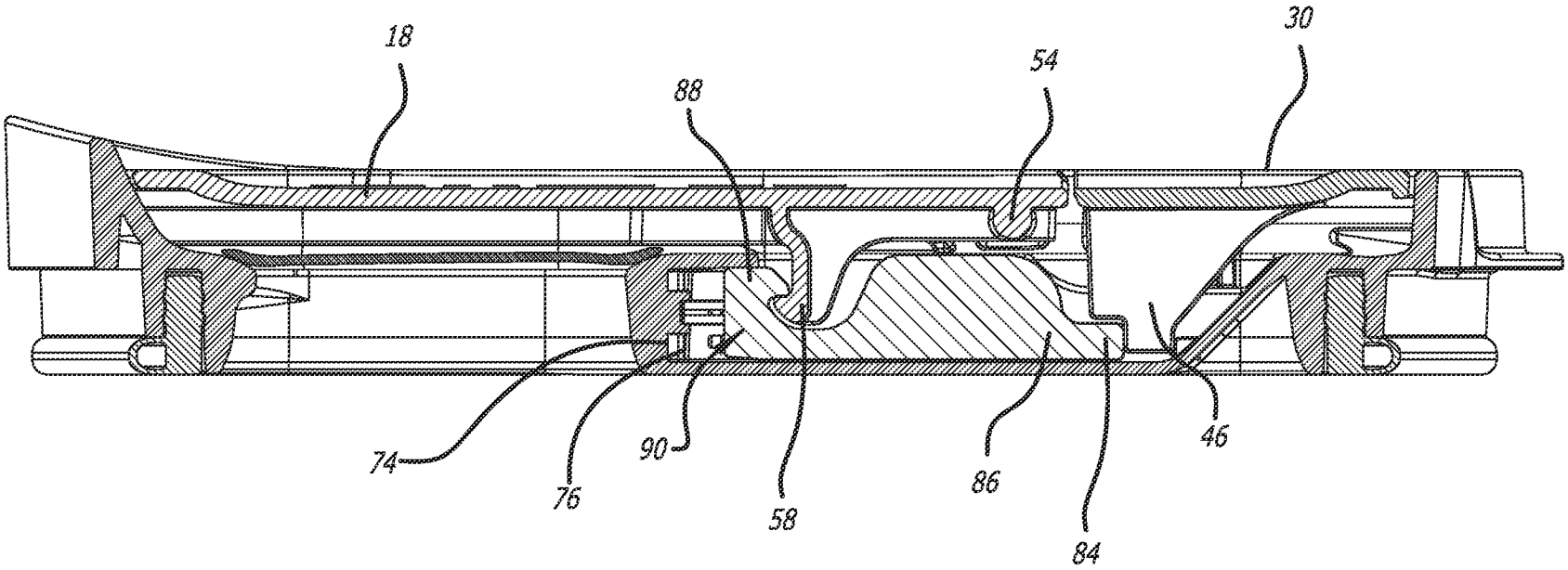
FIG. 7 is a cross-sectional view about a plane of a latch of one embodiment of a lid assembly and seal mechanism, with the seal mechanism in the closed position.
Figure 8:
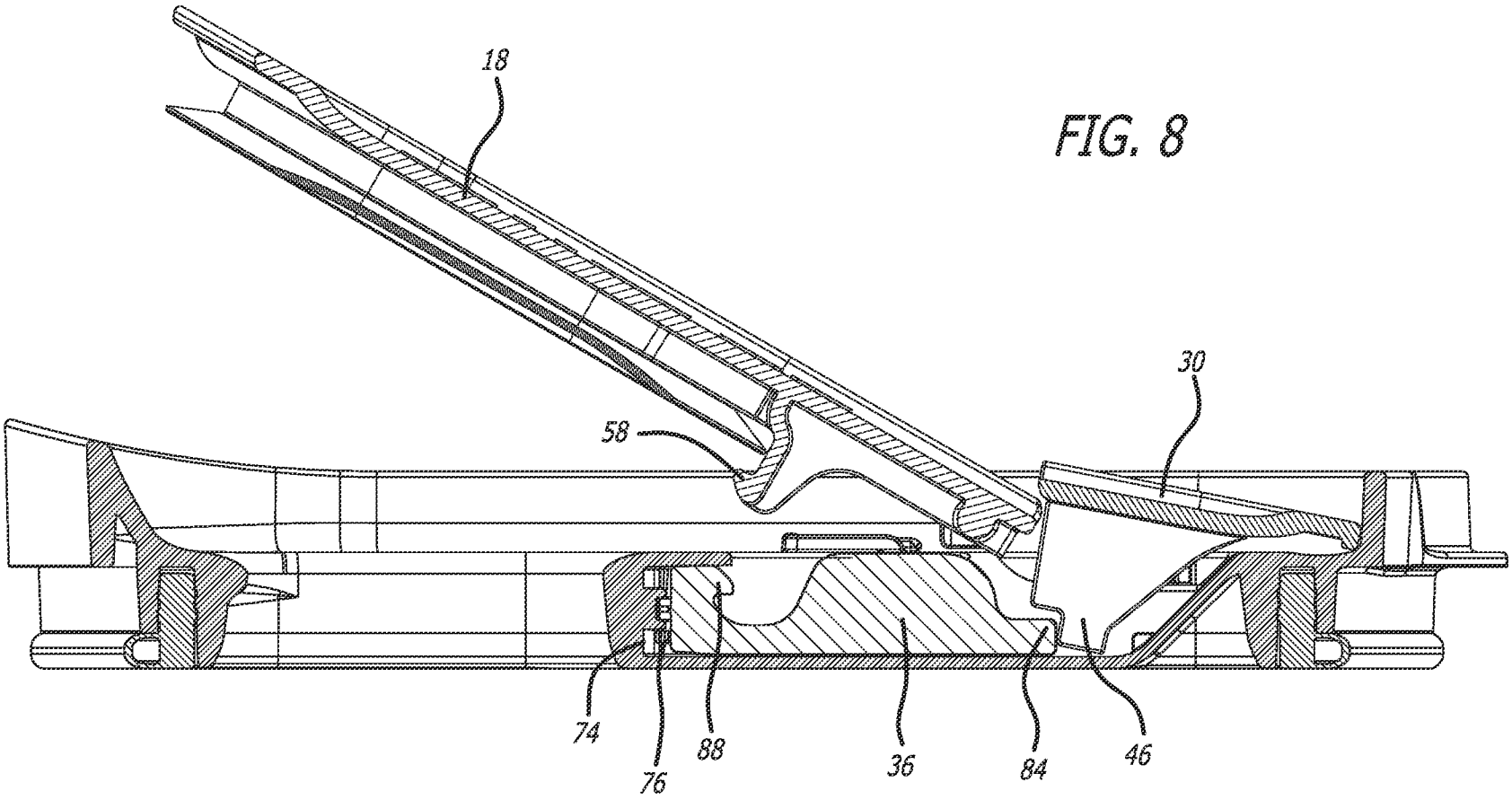
FIG. 8 is a cross-sectional view about a plane of a latch of one embodiment of a lid assembly and seal mechanism, with the seal mechanism in the open position.

Similarly, in one embodiment as shown in FIGS. 4, 7 and 8, the flap 18 has a first outer surface 50 and a second inner surface 52. The flap 18 also has opposing posts 54 that extend outwardly adjacent a first end 56 of the flap 18. The flap 18 is pivotally secured to the lid body 20 via the opposing posts 54, and can pivot between a closed position and an open position as shown in FIGS. 4 and 5. Additionally, in one embodiment, torsion springs 55 are provided around each post 54 to bias the flap 18 to the open position. A flap seal receiver 56 extends from the second inner surface 52 to receive the flap seal 16. Accordingly in one embodiment the flap seal 16 is connected to the flap 18 via the flap seal receiver 56. The flap 18 preferably has opposing hooks 58 extending from the second inner surface 52. The hooks 58 engage the latches 36 as described herein. In one embodiment, a stop 59 extends from the second inner surface 52 adjacent the first end 56 of the flap 18. As shown in FIG. 6, in one embodiment, the stop 59 contacts the first surface 60 of the lid body 20 when he flap 18 is pivoted to the fully open position, and prevents further pivoting thereof in the open direction.

Referring also to FIGS. 4, 7, and 8, the lid body 20 pivotally secures both the flap 18 and the button 30 thereto. The lid body 20 has a first surface 60, a second surface 62, a first end 61, a second end 63, and an exterior wall 64. The lid body 20 also has an opening 29 extending from the first surface 60 through to the second surface 62. In one embodiment, the opening 29 is provided adjacent a second end 63 of the lid body 20. In one embodiment, the lid seal 24 is connected to the lid body 20 adjacent the exterior wall 64 and preferably beneath the second surface 62. In one embodiment, the lid body 20 has a first set of receivers 66 for pivotally receiving the opposing posts 42 of the button 30, and a second set of receivers 68 for pivotally receiving the opposing posts 54 of the flap 18. In a preferred embodiment the receivers 66, 68 are provided adjacent or within an inner surface 70 of the exterior wall 64 of the lid body 20. Channels 72 are provided in the first surface 60 of the lid body 20 slidingly receive the latches 36. Openings 74 are provided in the channels 72 to secure bias members 76 for biasing the latches 36 to the first position of the latches 36. As shown in FIGS. 4-6, protrusions 78 extend from the first surface 64 to secure bias members 80 for the button 30. In one embodiment, bias members 80 comprise compression springs that bias the button 30 to the unactuated position. A second opening 81 is provided in the lid body 24 to secure the vent seal 22 thereto and also to allow for venting of the interior cavity 28 of the container body 26.

As shown in FIGS. 4, 7, and 8, the latches 36 transverse linearly within the channels 72 of the lid body 20. In one embodiment, the latches 36 have a cam surface 84 at a first end 86, and a hook member 88 toward a second end 90 thereof.

As shown in FIG. 7, when button 30 is in the unactuated position, the hook member 88 of the latches 36 engages the hook 58 of the flap 18 to secure the flap 18 and its closed position. As shown in FIG. 8, however, when the button 30 is pushed in by a user to its actuated position, the extensions 46 of the button 30 engage the cam surface of the latches 36 to move the latches 36 linearly toward the second end 63 of the lid body 20 and to disengage the hooks 58 of the flap 18 from the hook members 88 of the latches 36. When this occurs, the torsion springs 55 operate to pivotally bias the flap 18 to its open position. Additionally, as shown in FIG. 6, when the button 30 is actuated the vent plunger 44 operates to open the vent seal 22. In a preferred embodiment, the vent seal 22 opens before the flap seal. As soon as the user releases the button 30, the bias members 80 operate to bias the button 32 to the unactuated position. In one embodiment, when the button 30 transitions back to the unactuated position, the flap 18 will still remain in the open position until a user pushes the flap 18 toward the lid body to close the flap 18. When the user pushes the flap 18 to its closed position the hooks 58 of the flap will again engage hook members 88 of the latches 36 to retain the flap 18 in the closed position and the lid seal 24 will seal closed the lid opening 29. As shown in FIGS. 6 and 8, the flap and the button pivot in opposite directions.

The embodiments detailed hereinabove may be combined in full or in part, with any alternative embodiments described.

A reference to an element in the singular is not intended to mean "one and only one" unless specifically stated, but rather "one or more." The term "some" refers to one or more. Underlined and/or italicized headings and subheadings are used for convenience only, do not limit the subject technology, and are not referred to in connection with the interpretation of the description of the subject technology. Relational terms such as first and second and the like may be used to distinguish one entity or action from another without necessarily requiring or implying any actual such relationship or order between such entities or actions. All structural and functional equivalents to the elements of the various configurations described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description.

Numerous modifications to the present disclosure will be apparent to those skilled in the art in view of the foregoing description. Preferred embodiments of this disclosure are described herein, including the best mode known to the inventors for carrying out the disclosure. It should be understood that the illustrated embodiments are exemplary only, and should not be taken as limiting the scope of the disclosure.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. Additionally, the terms "first," "second," "third," and "fourth" as used herein are intended for illustrative purposes only and do not limit the embodiments in any way. Further, the term "plurality" as used herein indicates any number greater than one, either disjunctively or conjunctively, as necessary, up to an infinite number. Additionally, the term "having" as used herein in both the disclosure and claims, is utilized in an open-ended manner.

As used herein, the phrase "at least one of" preceding a series of items, with the terms "and" or "or" to separate any of the items, modifies the list as a whole, rather than each member of the list (i.e., each item). The phrase "at least one of" does not require selection of at least one item; rather, the phrase allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

To the extent that the term "include," "have," or the like is used in the description or the claims, such term is intended to be inclusive in a manner similar to the term "comprise" as "comprise" is interpreted when employed as a transitional word in a claim. Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase (s) may provide one or more examples. A phrase such as an aspect or some aspects may refer to one or more aspects and vice versa, and this applies similarly to other foregoing phrases.

A reference to an element in the singular is not intended to mean "one and only one" unless specifically stated, but rather "one or more." The term "some" refers to one or more. Underlined and/or italicized headings and subheadings are used for convenience only, do not limit the subject technology, and are not referred to in connection with the interpretation of the description of the subject technology. Relational terms such as first and second and the like may be used to distinguish one entity or action from another without necessarily requiring or implying any actual such relationship or order between such entities or actions. All structural and functional equivalents to the elements of the various configurations described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description. No claim element is to be construed under the provisions of 35 U.S.C. § 112, sixth paragraph, unless the element is expressly recited using the phrase "means for" or, in the case of a method claim, the element is recited using the phrase "step for."

While this specification contains many specifics, these should not be construed as limitations on the scope of what may be claimed, but rather as descriptions of particular implementations of the subject matter. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

The title, background, brief description of the drawings, abstract, and drawings are hereby incorporated into the disclosure and are provided as illustrative examples of the disclosure, not as restrictive descriptions. It is submitted with the understanding that they will not be used to limit the scope or meaning of the claims. In addition, in the detailed description, it can be seen that the description provides illustrative examples and the various features are grouped together in various implementations for the purpose of streamlining the disclosure. The method of disclosure is not to be interpreted as reflecting an intention that the claimed subject matter requires more features than are expressly recited in each claim. Rather, as the claims reflect, inventive subject matter lies in less than all features of a single disclosed configuration or operation. The claims are hereby incorporated into the detailed description, with each claim standing on its own as a separately claimed subject matter.

It will be understood that the present disclosure may be embodied in other specific forms without departing from the spirit or central characteristics thereof. The present examples and embodiments, therefore, are to be considered in all respects as illustrative and not restrictive, and the Claims are not to be limited to the details given herein.

Accordingly, while the specific embodiments have been illustrated and described, numerous modifications come to mind without significantly departing from the spirit of the disclosure and the scope of protection is only limited by the scope of the accompanying Claims.

Further, the claims are not intended to be limited to the aspects described herein, but are to be accorded the full scope consistent with the language claims and to encompass all legal equivalents. Notwithstanding, none of the claims are intended to embrace subject matter that fails to satisfy the requirements of the applicable patent law, nor should they be interpreted in such a way.

What is claimed is:

1. A lid assembly for a container, comprising:

a lid body having a first end and a second end, a lid opening extending through the lid body adjacent the second end of the lid body, and a vent opening;

a flap pivotally connected to the lid body, the flap pivoting between an open position and a closed position, wherein the flap closes the lid opening in the lid body when the flap is in the closed position, and wherein when the flap is in the open position the lid opening in the lid body is open and a cavity of the container is accessible therethrough;

a seal connected to the flap to seal the opening when the flap is in the closed position;

a linearly moveable latch moving from a first position to a second position, the latch having a cam surface and an engaging member, the engaging member adapted to secure the flap in the closed position when the latch is in the first position, and the engaging member adapted to release the flap to the open position when the latch is in the second position;

a button pivotally connected to the lid body adjacent the first end of the lid body, the button pivoting between an actuated position and an unactuated position, the button having an extension that engages the cam surface to move the latch from the first position to the second position when the button is moved to the actuated position, the button further having a vent plunger;

a vent seal within the vent opening, the vent plunger engaging the vent seal to open the vent opening when the button is moved to the actuated position.

2. The lid assembly of claim 1, further comprising a lid seal around the lid body for sealing the lid body against the container.

3. The lid assembly of claim 1, wherein the flap has pivot members extending therefrom, the pivot members of the flap engaging receivers of the lid body, and the flap pivoting about the pivot members in the receivers.

4. The lid assembly of claim 3, wherein the button has pivot members extending therefrom, the pivot members of the button engaging receivers of the lid body, and the button pivoting about the pivot members in the receivers.

5. The lid assembly of claim 1, further comprising a bias member to bias the flap to the open position.

6. The lid assembly of claim 5, further comprising a bias member to bias the button to the unactuated position.

7. The lid assembly of claim 6, further comprising a bias member to bias the latch to the first position.

8. The lid assembly of claim 1, wherein the flap has a hook extending from the flap to engage the engaging member of the latch when the flap is moved to the closed position.

9. The lid assembly of claim 1, wherein the lid body has a channel to slidingly receive the latch.

10. A lid assembly for a container, comprising:

a lid body having a first end and a second end, a lid opening extending through the lid body adjacent the second end of the lid body;

a flap pivotally connected to the lid body, the flap pivoting between an open position and a closed position, wherein the flap closes the lid opening in the lid body when the flap is in the closed position, and wherein when the flap is in the open position the lid opening in the lid body is open and a cavity of the container is accessible therethrough;

a seal connected to one of the lid body and the flap to seal the opening when the flap is in the closed position;

a latch moveable about the lid assembly from a first position to a second position, the latch adapted to secure the flap in the closed position when the latch is in the first position, and the latch adapted to release the flap to the open position when the latch is in the second position, wherein the latch has an engaging member, the engaging member adapted to secure the flap in the closed position when the latch is in the first position, and the engaging member adapted to release the flap to the open position when the latch is in the second position; and, a button pivotally connected to the lid body adjacent the first end of the lid body, the button pivoting between an actuated position and an unactuated position, the button operably moving the latch from the first position to the second position when the button is moved to the actuated position.

11. The lid assembly of claim 10, wherein the lid body has a vent opening, wherein a vent seal is provided within the vent opening, wherein the button has a vent plunger, and wherein the vent plunger engages the vent seal to open the vent opening when the button is moved to the actuated position.

12. The lid assembly of claim 10, wherein the button has an extension that engages a cam surface of the latch to move the latch from the first position to the second position when the button is moved to the actuated position.

13. A lid assembly for a container, comprising:

a lid body having a first end and a second end, a lid opening extending through the lid body adjacent the second end of the lid body;

a flap pivotally connected to the lid body adjacent the second end of the lid body, the flap pivoting away from the lid body between an open position and a closed position, wherein the flap closes the lid opening in the lid body when the flap is in the closed position, and wherein when the flap is in the open position the lid opening in the lid body is open and a cavity of the container is accessible therethrough;

a seal connected to one of the lid body and the flap to seal the opening when the flap is in the closed position;

a button pivotally connected to the lid body adjacent the first end of the lid body, the button pivoting between an actuated position and an unactuated position, the button operably moving the flap from the closed position to the open position when the button is moved to the actuated position;

a first bias member to bias the flap to the open position; and, a second bias member to bias the button to the unactuated position.

14. The lid assembly of claim 13, further comprising a latch moveable about the lid assembly from a first position to a second position, the latch adapted to secure the flap in the closed position when the latch is in the first position, and the latch adapted to release the flap to the open position when the latch is moved to the second position, wherein the button moves the latch from the first position to the second position to open the flap.

15. The lid assembly of claim 14, wherein the latch has a cam surface and an engaging member, the engaging member adapted to secure the flap in the closed position when the latch is in the first position, and the engaging member adapted to release the flap to the open position when the latch is in the second position.

16. The lid assembly of claim 14, wherein the button has an extension that engages the cam surface of the latch to move the latch from the first position to the second position when the button is moved to the actuated position.

17. The lid assembly of claim 13, further comprising a lid seal around the lid body for sealing the lid body against the container.

18. The lid assembly of claim 13, wherein the flap and the button pivot in opposite directions.

* * * * *